United States Patent [19]

Kleitz et al.

[11] Patent Number: 4,949,910

[45] Date of Patent: Aug. 21, 1990

[54] UNWINDING MACHINE

[75] Inventors: Claude Kleitz, Strasbourg; Gérard Maetz, Eckbolsheim; Bernard Muller, Drusenheim; Jean-Claude Thien, Herrlisheim; Marcel Loesch, Eckbolsheim; all of France

[73] Assignee: Monomatic S.A., Strasbourg-Koenigshoffen, France

[21] Appl. No.: 221,468

[22] Filed: Jul. 19, 1988

[30] Foreign Application Priority Data

Jul. 29, 1987 [FR] France ..... 87 10863

[51] Int. Cl.[5] ..... B65H 19/18

[52] U.S. Cl. ..... 242/58.1; 242/58.6; 156/502

[58] Field of Search ..... 242/58.1–58.6, 242/; 156/502, 501–508

[56] References Cited

U.S. PATENT DOCUMENTS

| | | | |
|---|---|---|---|
| 3,753,833 | 8/1973 | Bassett et al. | 156/504 |
| 3,780,960 | 12/1973 | Tokuno et al. | 242/58.1 |
| 3,841,944 | 10/1974 | Harris, Jr. | 242/58.1 X |
| 3,891,158 | 6/1975 | Shearon et al. | 242/58.1 |
| 3,895,763 | 7/1975 | Tokuno | 242/58.3 |
| 3,918,655 | 11/1975 | Hillner et al. | 242/58.1 |
| 4,100,012 | 7/1978 | Meihofer et al. | 156/504 X |
| 4,281,803 | 8/1981 | Massey | 242/58.1 |
| 4,450,039 | 5/1984 | Salvucci et al. | 156/504 |
| 4,586,673 | 5/1986 | Tokuno et al. | 242/58.6 |
| 4,792,103 | 12/1988 | Schoonderbeek | 242/58.1 |

FOREIGN PATENT DOCUMENTS

| | | |
|---|---|---|
| 2207496 | 6/1974 | France . |
| 2231223 | 12/1974 | France . |
| 2511351 | 2/1983 | France . |

*Primary Examiner*—Stuart S. Levy
*Assistant Examiner*—Steven M. DuBois
*Attorney, Agent, or Firm*—Young & Thompson

[57] ABSTRACT

Unwinding machine comprising two reelstand towers (1) covered by an overhead bridge (2) supporting a web accumulator (3), and two splicing cases (4) adapted to splice webs at zero speed each being linked to one of the reelstand towers (1) and rolling along rails fastened under the bridge (2). Each reelstand tower (1) is constituted by a frame (5) connected to the bridge (2) and a mobile frame (6) movable on the frame (5) perpendicularly to the bridge length (2), this frame (6) bearing also a device (7) to vertically move the cantilever spindle (8) to be inserted into the new reel core (9) to be unwound and following the transverse movements of the corresponding splicing case (4). The mobile frame (6) either follows rails on the frame (5), or rolls on this frame (5), the transverse movement being power controlled.

15 Claims, 4 Drawing Sheets

UNWINDING MACHINE

Figure 1:
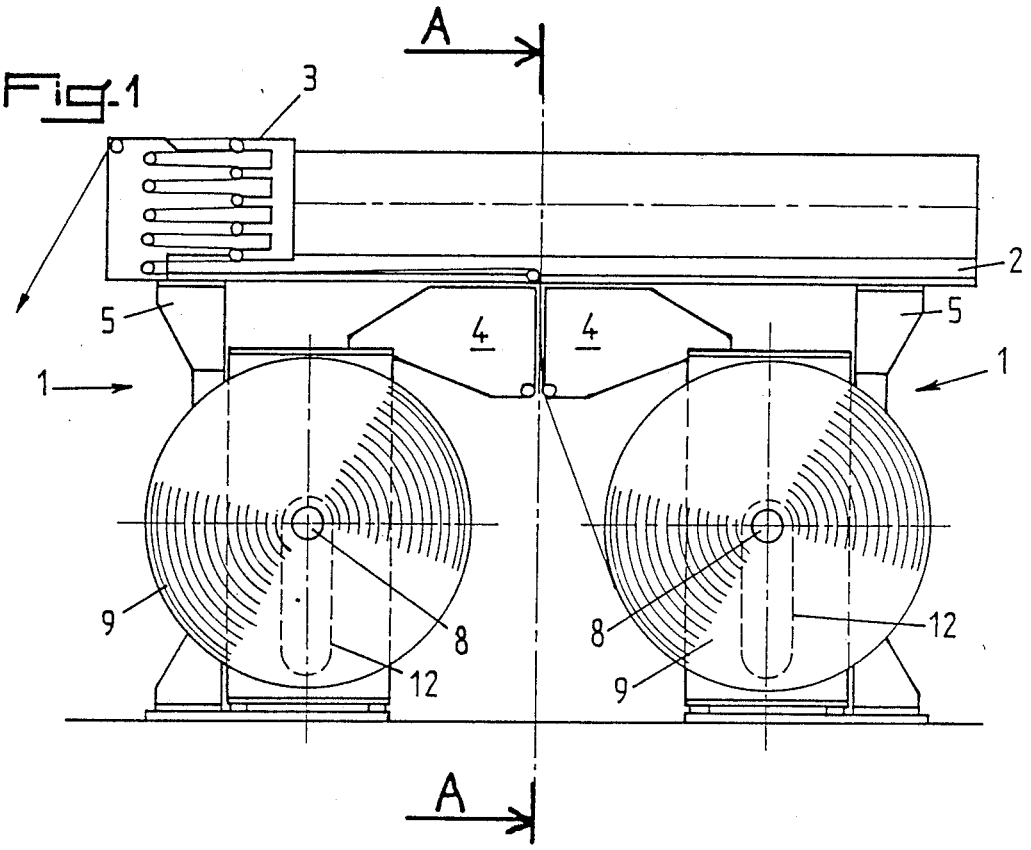

The present invention deals with reel unwinding techniques for webs to feed, particularly in continuous operation, printing machines, coaters, sheeters or other converting presses, and consists in an unwinding machine.

Unwinding machines exist already to feed the above-mentioned converting presses, but they are generally not perfectly suitable because of their large size or weight which do not allow an easy installation in upper floors of a building equipped with inadequate elevators.

Moreover in existing unwinders, the reel is loaded following a movement which is almost always circular, because the reel centering heads or spindles are usually fit at the end of a pivot or on a rotating circular plate. Unfortunately, the reel axis stays in a horizontal plane when the reel is rolled on the floor in front of the reelstand. Therefore, the operator has the awkward obligation to perform complicated successive movements of all elements until the centering heads are in front of the centre of the reel to be loaded.

Moreover, certain types of unwinders have the drawback that the operator is obliged to push the reel by himself parallely to the reel axis, in order that the cantilever unwind shaft penetrates into the core of the reel. For this movement, the operator needs the assistance of more or less motorized, and expensive handling means.

Certain unwinding machines can be found where a speed-control-belt is applied on a section of the reel periphery during the whole unwinding procedure. This construction has the considerable drawback of subjecting the paper periphery of the reel to contact and drive power effects, which certainly are detrimental to the surface quality—particularly if covered with printing, or perforated—in case of acceleration or of emergency stopping.

Furthermore with this belts system, the operator, who is obliged to work in the neighbourhood of the reel, is exposed to certain dangers particularly due to this reel drive-belt, the lay-out of which is contrary to usual safety regulations.

We also know existing machines, which splice the tail of a finishing reel to the beginning of a new reel during a temporary stop of the unwinder, it being understood that a web accumulator has been provided and preliminarily filled-up, to keep web going to the main machine during the splice stop.

Nevertheless, in all the above-mentioned machines, there is no fully safe means to guarantee that the web splice will not fall in a critical zone later in the fed press, for example under the tool of a cutter or creaser or perforator which would not accept the excessive web thickness due to adhesive tape patches along the web splice. You risk a jam-up and a long machine stop.

A solution has been to speed-up the new reel at the very moment when the web accumulated length is a multiple of the repeat length of the converting operation, plus a fraction of it, depending on the desired position of the splice.

But, taking into account the elasticity of such a long web of several dozens of meters, it is not possible to count on reliable lengths; hence a non-precise positioning of the splice occurs.

The present invention overcomes these drawbacks, by providing a nonstop unwinder characterized by the fact that it is constituted by two reelstand towers covered by an overhead bridge. This bridge carries an accumulator of web, as well as two splicing cases able to run on rails across the web, each of them being mechanically connected to the reelstand.

Figure 2:
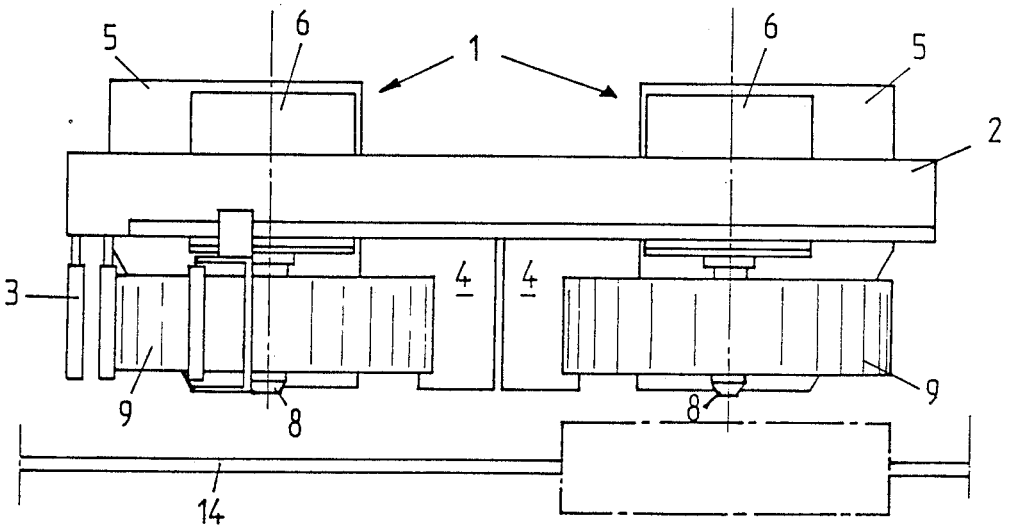
Figure 3:
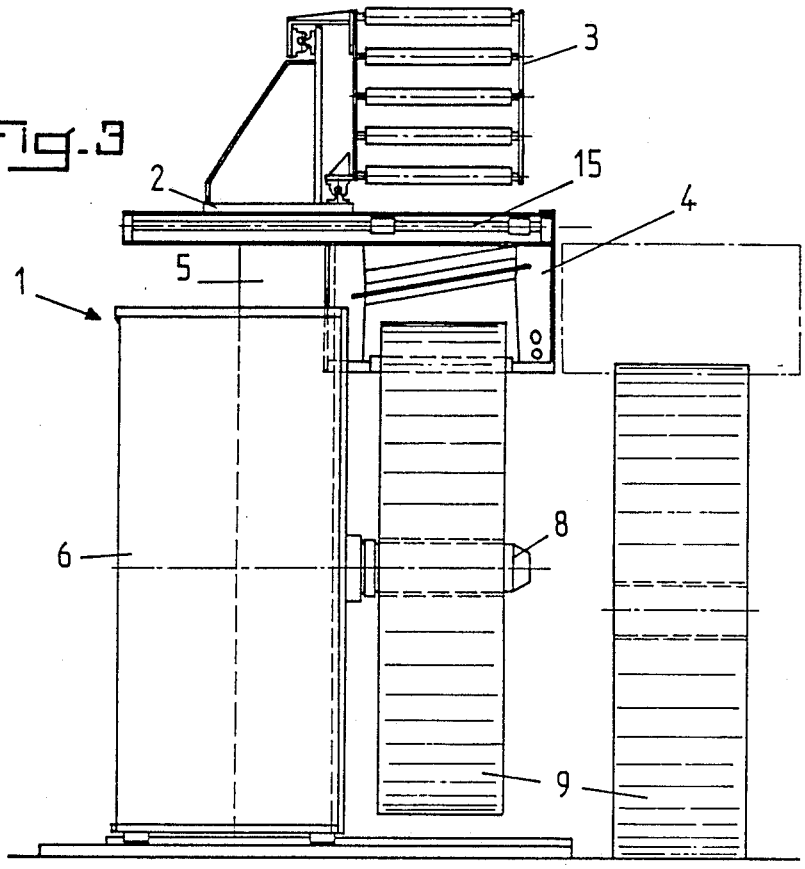
Figure 6:
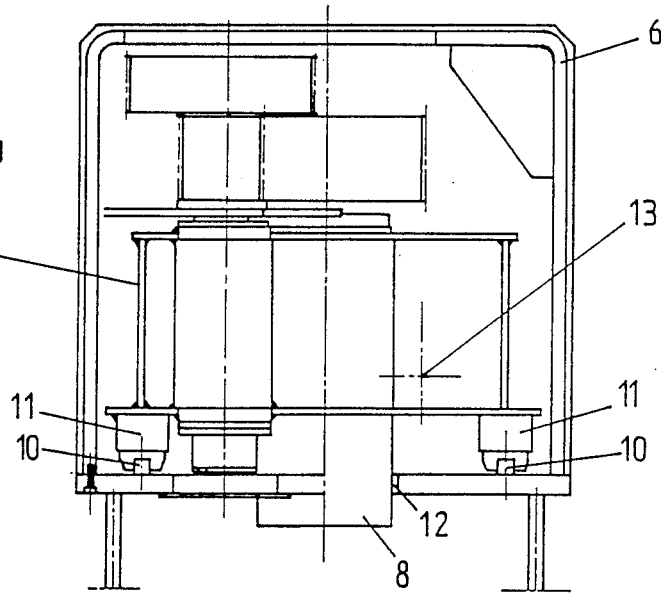
Figure 4:
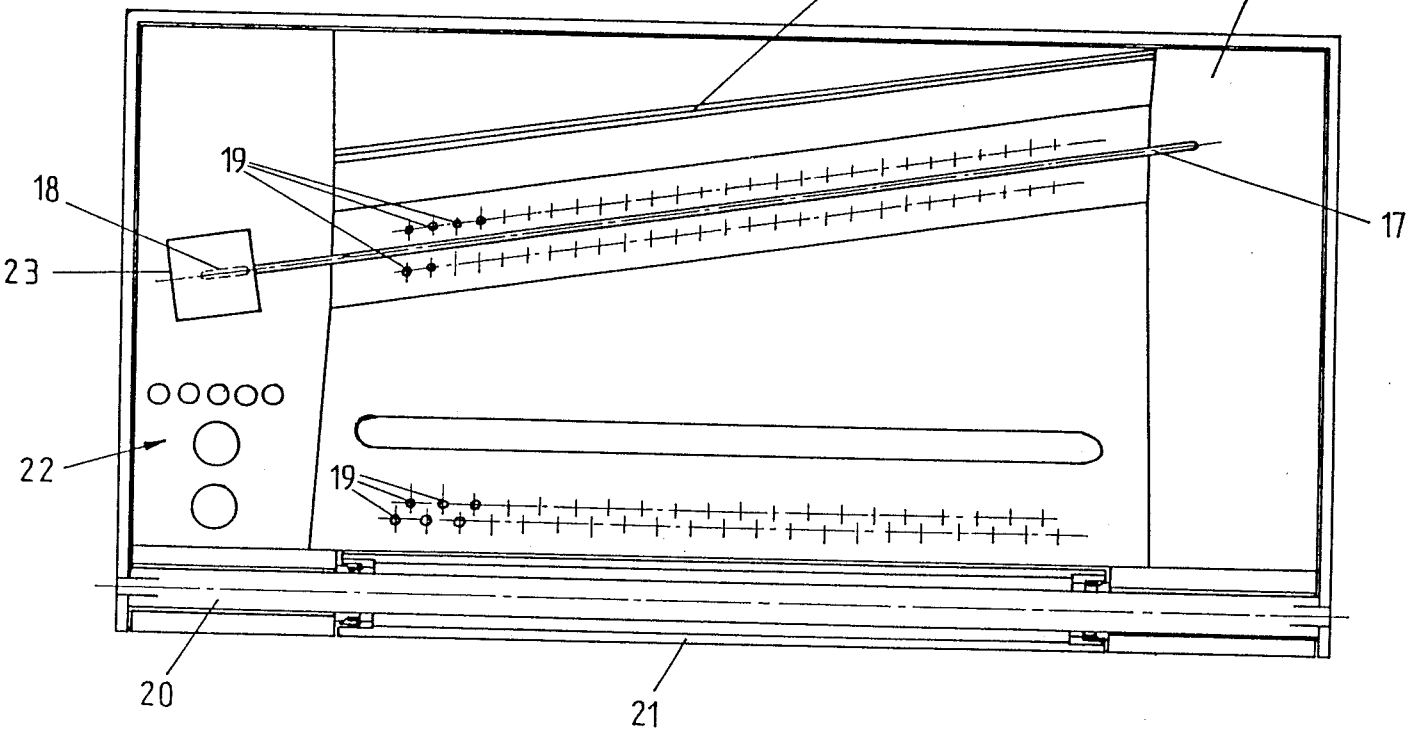
Figure 5:
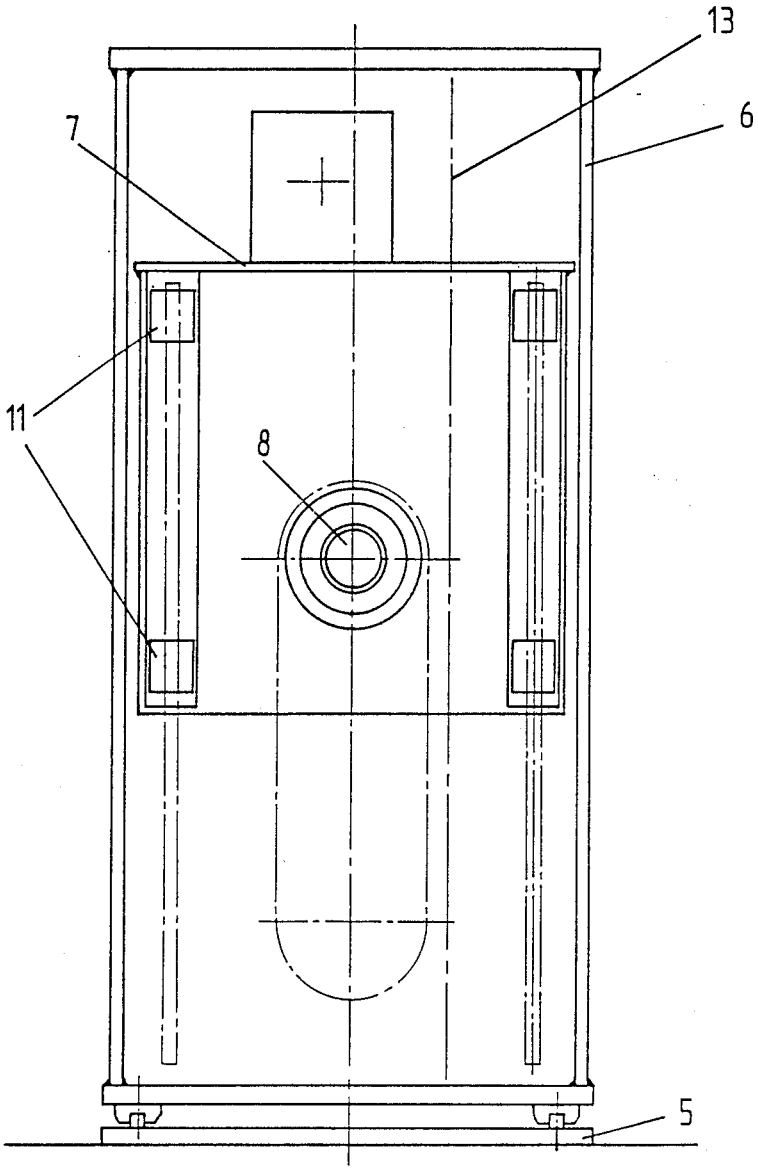

The invention will be better understood, thanks to the following description, which deals with a preferred construction, given as a non-limiting example and explained with the accompanying drawings in which:

FIG. 1: is a side elevational view of the invented machine;

FIG. 2: is a top plan view thereof;

FIG. 3: is a front view on a larger scale, sectioned on line A—A of FIG. 1;

FIG. 4: is a view on a larger scale, in elevation and partially in section, of a splicing case;

FIG. 5: is a view on a larger scale, in front elevation and in section of a reelstand tower; and FIG. 6: is a sectional view from above.

In accordance with the invention, and as better shown on enclosed FIGS. 1 and 2, as examples, this unwinder essentially consists of two towers 1, each one able to carry a reel, and covered by an overhead bridge 2. This bridge carries a web accumulator 3, and two cases 4 to splice webs at zero speed. Each one of these two cases 4 is mounted on one of the reelstand towers 1, and runs on rails across the web width, i.e. under the bridge 2.

Each reelstand tower 1 is composed of a frame 5 connected to the bridge 2, and by a mobile frame 6 which can move on the frame 5 perpendicularly to the bridge 2. Moreover, this frame 5 includes a vertical lifting means of the cantilever reel centering spindle 8, to be inserted in the reel 9 to be unwound. Each frame 5 is connected to a corresponding splicing case 4 (FIGS. 1, 4, 5 and 6).

The guiding of the mobile frame 6 with the frame 5 is possible thanks either to rails, or by rolling means on the base plate of the said frame 5. Its movements across the web running direction are controlled by a screw and nut mechanism or a fluid cylinder, or a rack and pinion, or the like.

The assembly of the mobile frame 6 on the frame 5 allows a displacement of the said frame 6 from its normal unwinding position towards a new reel loading position, in order to introduce the cantilever spindle 8 into the core of the reel 9 and then load the latter.

The vertical lifting means 7 of the cantilever spindle 8 is built like a suspended cage carrying this spindle. It lodges the drive mechanisms and motor for this spindle, i.e. a DC motor controlled by a four-quadrant type variator. This cage is guided vertically by rails 10 placed on the front face of the mobile frame 6. The connection with the rails is done by skates, or gliding elements. The cantilever spindle extends through a big vertical slot in the front face of the frame 6. A vertical drive mechanism 13 driven by a motor or manually will allow moving this suspended cage, be it by a screw and nut assembly or a crank and pinion, or a fluid cylinder.

In FIGS. 5 and 6 of the enclosed drawings, the mechanism 13 is illustrated only by an axis line, to simplify the drawing.

The machine explained in this text can moreover be completed in front of the frames 5 by a reel conveyor, for example a rail for a transport carriage (not shown on the drawing) meant to bring the new reels from their storage area to our machine, i.e. exactly in front of the cantilever spindle 8 of the reelstand tower 1 automatically, thanks to well-known position detectors or limit switches.

According to another characteristic of the invention, each mobile frame 6 of the reelstand towers 1 is equipped with a detector of the reel diameter of the reel, either of mechanical type, or of electromagnetic type or of radar type, or of photoelectric type, connected to a computer controlling the mechanism 13 of the vertical movement of the spindle lift cage 7. Such detection means connected to computers are already known and therefore will not be described in greater detail.

These prnciples allow a complete automatisation of the reel loading, because the new reels coming from their storage area can be stopped and presented in front of the unwind spindle 8 with adequate precision; then they can be loaded safely by automatic movements of the mobile frame 6.

According to another characteristic of the invention, the mechanism 13 is advantageously secured at its connection with the frame 6 or with the cage 7, to a strain gage (not illutrated), the latter being connected electrically to a computer controlling the reel stock additions and withdrawals. This very convenient design allows the most direct and precise weighing of each reel before and after its unwinding on the spindle 8. Therefore the owner of such a machine does not meed to buy a separate and expensive weigher to be usually lodged in the floor. As a matter of fact the presence of the above-mentioned strain-gauge and of the attached computer means do provide better control and register actual consumptions of paper for specific productions, i.e. taking into account the gross weight of the reel in stock diminished first by the taken-off outer windings which had been damaged by transport, then substracting the weight of the remaining and still usable reel at the end of a specific job.

Strain gauge principles are known and will not be explained here again.

The procedures for loading a new reel on the cantilever spindle can advantageously be controlled by a programmable automat (PLC), so that reel change can be done by a simple first order to move the tower 1, to its loading position. The automat then will follow up all controls until the new reel 9 is on the cantilever spindle 8, ready for unwinding, bearing in mind that the mobile frame 6 also allows fine corrections of the lateral positioning of the new reel 9.

According to another characteristic of the invention, the mobile frame 6 is advantageously fit with a blocking means of the vertical movement of the lifting cage 8 for full safety of operations.

The splicing cases 4 are assembled facing each other, under the bridge 2, and can be moved perpendicularly to the latter thanks to horizontal rails 15 fixed to the same bridge structure 2 and inclined towards the operator side. As already said, each case 4 is mechanically linked to a corresponding reelstand tower 1 (FIG. 3). Due to this assembly means, each case 4 faithfully follows every horizontal movement of its reelstand tower 1.

On each splicing case 4, the face looking towards the opposite case consists of a strong plate 16 carrying a certain number of pieces of equipment. First of all it has a long transverse slot 17 inclined to the horizontal. This slot 17 allows a cutting knife assembly 18 to run across the web width under the power of a pneumatic or electric drive. This plate 16 has also rows of holes 19 on both sides of the slot 17, and also a series of holes along the lower border of the plate 16. The surface of the plate 16 is not uniplanar but lies in three planes, the protruding central plane lodging the transverse slot 17. The pivot 20 of the plate 16 is along its lower border and is fixed to the bottom of the case 4, the axis of this pivot 20 also being used as the centering means of a pass roller 21 for the running web.

The case 4 obviously is larger than the largest web to be unwound, and offers even more surface to conveniently lodge several instruments or control buttons for the operator, as well as safe storage place for the knife 18 when not in use.

Moreover, the plates 16 of the cases 4 are, on the one hand, symmetrical to a vertical plane extending between these cases 4 and, on the other hand, equipped on their back with pneumatic or mechanical means to move them back and forth, either by a pneumatic cylinder of by a motorized cam, or a similar means.

This pivoting movment of the plates 16 one toward the other is provided so as to allow a perfect squeezing or ironing of the adhesive splice of the finishing web to the new web.

This design also gives to the operators the choice to splice the said webs either butt-to-butt or overlapped.

In fact the slot 17 and its incorporated knife performs butt-to-butt splices, whereas a parallel groove 24 is provided for overlapped splices. The distance between this groove and the slot can be at least equal to the width of a double-face adhesive splice of the finishing and the new web. This lay-out allows the operator to cut webs at a suitable level for overlapped splices.

The operation of the machine begins by the loading of a new reel on a cantilever spindle 8 of a reelstand tower 1. Then the reel is lifted thanks to the cage 7 to its upper end position. Then the dirty or damaged outer windings of the new reel are removed. Then the beginning of the new web is fed to the appropriate plate 16 of the case 4—this is done when the tower 1 is in advanced position for the loading of the reel 8, in other words when it can be safely done by the operator outside of the bridge covered area, under good ergonomical conditions. The operator can conveniently work with his hands at eye level to fasten the new web on the plate 16 of the case 4 thanks to a vacuum pump sucking through the holes 16, after pushing a relevant button of known construction.

After this is done, the web front will be cut in tapered shape, either manually or by a knife 18 automatically guided along the slot 17, letting the unnecessary web tail be taken off.

The vacuum on the holes 19 on both sides of the slot 17 is then released, in order to allow a provisional pulling away of the front-edge of the new web from the plate 16. This gives a way for the operator's hands to fit an adhesive tape along the axis of the slot 17. This tape will be held on the plate 16 by applying vacuum again to the holes 19 along the slot 17.

And then the tail of the web can be moved forward again and applied along the lower half of the tape in view of the future butt-splice. Consequently, the web front of the new reel is ready to be spliced, and the operator can give the order to the reelstand tower 1 to move back to its normal unwinding position, together with its associated slicing case 4. Until actual splicing, the new reel will be blocked to avoid any rotation, by a small brake of known design.

To splice webs in overlapped fashion, the above-mentioned cutting of the new web by a manually operated knife, must be done along the other slot 24. The resulting additional web length, fastened on the plate 16 of the splicing-case 4, will have to be fitted with a double-face adhesive tape. All the other operations will be indentical to those in case of a butt-splice.

When leading the tower 1 back to its base position, a good lateral positioning of the new reel with regard to the finishing one can easily be made, as explained above. You can even later control synchronous movements of the two towers 1 automatically in order to keep their common alignment in view of a future perfect web splice, made by the splicing cases 4.

Considering a splicing-knife slot 17 having an incline, the splicing cases 4 can advantageously roll along rails 15 which are inclined too i.e. parallel to the slots 17, so that these slots glide always perfectly face to face, even when the cases 4 move separately.

The predetermined minimum diameter of the unwinding reel can be detected by known means, like an optical photocell, or a hyperfrequency radar, or by an electronic calcultor of diameter.

When this minimum diameter is reached, the detector will order the splice of the new reel, either automatically, or by a sound or light warning to the operator. At this moment, the web accumulator 3 is normally full, so that the finishing reel can be braked to a total stop, thanks to the DC motor driving the spindle 8. The vacuum system connected to the holes 19 of the plate 16 of the corresponding case 4 will be switched on, and the knife 18 of the same splicing case 4 receives a cutting order. As a result, the finishing web will be cut on the bias. Then, its upstream tail, on the finished reel side, is pulled back automatically from the plate 16 after first switching off the vacuum, and secondly reversing the drive direction of the DC motor of the corresponding spindle 8.

Moreover, depending on the quality and rigidity of the web, a removable counter-part bar can advantageously be applied to the web along the cutting slot 17, to keep it safely flat for a clean cut. This counter-part bar can easily be brought foreward and backward by two simple pneumatic cylinders, just for the cutting period.

Then, both plates 16 of the two splicing cases 4 are pushed toward one another, by turning each about its axis 20, in order to bring the tail of the finishing web to be pressed on the adhesive tape preliminarily fitted along the leading edge of the new web waiting to be spliced. This movement of the plates 16 is very quick and firm. After sticking the two web ends together, it switches the vacuum off from the holes 19 and simultaneously starts the unwinding DC motor controlling the spindle 8 of the new reel. This very spindle is therefore accelerated up to the necessary unwinding speed, following which the web accumulator 3 can begin its refill operation.

The motors driving the spindles 8 on the towers 1 can advantageously be equipped with known DC controls sufficiently powerful to speed up or down quickly the reels, as to avoid an over-dimensioning of the web accumulator 3. The power controls are subjected to two variables, i.e. the web speed of the main press fed by the unwinder, and the web tension preliminarily indexed and permanently checked at several points. All these variables and others can be simultaneously monitored and controlled by a computer making sure that the necessary web flow is fed with the desired web tension, despite the variations of production speed, or web splices operation on the accumulator 3.

The position of the mobile carriage 3 is permanently controlled thanks to a special motor linked to a strain gauge on the mobile carriage. This strain-gauge can also be fitted to a pass-roller placed at the end of the said carriage, in order to continuously check the web tension, which must remain constant thanks to the combined effects of the mobile carriage 3 and of the DC drive motor of the spindle 8.

Moreover, according to another characteristic of the invention, the unwinder can be equipped with a web-marking system (not illustrated) advantageously placed near the case 4 adjacent the accumulator 3, over the slot 17 of the plate 16, or on the upper side of this case, or even at the inlet of the accumulator 3. This can be a mechanical perforating system or an ink printing or jetting system, anyhow periodically marking the web at the same periodicity as that of the printing or cutting done downstream by the main press. This system must be placed at a chosen distance from the slot 17 equal to one or a fraction of one period of the downstream converting or printing. In the latter case, one period corresponds to the exact fixed length of web treated by the main press, for example in case of an envelope making machine, the length of paper necessary to make one envelope. Therefore, with adequately matching periodicity and markings position on the web, you can make sure that the future web splice will always be made on an area not subject to future converting, cutting or folding, and therefore avoid detrimental web jamp-ups or damage to tools. This system keeps you free from errors due to web elasticity.

In the case of heavy reels or of large web widths, another characteristic of the invention is to provide (non illustrated) supporting arms for the cantilever extremity of the spindle 8. These arms can be fixed on frame 6 of the tower 1, in a removable way by a telescoping assembly corresponding to the vertical movments of the movable frame 7, as well as to follow the frame 6, or by means of separate driving means controlled simultaneously and identically to the driving means of the frame 6.

Thanks to this invention, it is possible to unwind a continuous web from reels that can be loaded automatically and due to splices respecting even pre-printed reels illustrated periodicity. As well, it allows you to avoid having the web splice fall in a dangerous area of the following converting press, e.g. under the cutting knife or in the folding crease. Moreover the fact of a biased cut of the splice edge, equally for butt splices or for overlapped splices, favors considerably a smooth flow of the web through the downstream main press and provides safe conditions for a better productivity.

Of course, the present invention is not strictly limited to the herewith described and illustrated mode of construction. Some modifications are possible particularly regarding the shape of the various elements, or by substituting technical equivalents, without departing from the protection of this invention.

We claim:

1. Unwinding machine comprising two reelstand towers (1) covered by an overhead bridge (2) supporting a web accumulator (3), wherein each reelstand tower (1) comprises a fixed frame (5) connected to the bridge (2) and a movable frame (6) movable on the fixed frame (5) perpendicularly to the bridge length (2), and two splicing cases (4) adapted to splice webs at zero speed each being rigidly secured to one of the movable frames (6) for movement therewith and rolling along rails fastened under the bridge (2).

2. Machine, according to claim 1, wherein said movable frame (6) comprises means (7) to vertically move the cantilever spindle (8) to be inserted into the new reel core (9) to be unwound and following the transverse movements of the corresponding splicing case (4).

3. Machine according to claim 1, in which the mobile frame (6) either follows rails on the frame (5), or rolls on this frame (5), said transverse movement being controlled by power means.

4. Machine according to claim 2, in which the means (7) for the vertical movement of the spindle (8) is a lift cage supporting the spindle (8), and lodging all the driving means of the latter and guided on rails (10) by pads (11), the cantilever spindle (8) extending through a slot (12) in the front face of the frame (6), and a mechanical system acting on the said cage (7) by power means.

5. Machine according to claim 1, having also a reel conveyor (14) extending along the reelstand towers (1) and adapted to bring a new reel and stop it just in front of the axis of a cantilever spindle (8) by locator means.

6. Machine, according to claim 2, in which each mobile frame (6) of the reelstand towers (1) is fitted with a reel diameter detector connected to a computer controlling the drive of the vertical movements of the cage (7), in order that reel loading can be automatic.

7. Machine, according to claim 6, in which said mechanism (13) is provided at an anchor-point to the frame (6), or on the cage (7), with a strain-gauge, this gauge being advantageously connected to a reel stock computer.

8. Machine, according to claim 4, in which the mobile frame (6) has safety means to block the driving means of the vertical movement of the lift-cage (7).

9. Machine, according to claim 1, in which the splicing cases (4) are assembled face to face, under the bridge structure (2) and said rails (15) extend traversely to the bridge (2), such that the cases may protrude toward the operator side for easy access, the guiding rails for each case being parallel to a cutting slot (17) of each case, thus permitting both slots (17) to glide along each other whatever the positions of the tower (1).

10. Machine, according to claim 1, in which each splicing case (4) has a plate (16) turned toward the other case (4) and comprising a long inclined transverse slot (17) extending therealong lodging a power-driven cutting device (18), and sevral rows of holes (19) cooperating with a vacuum means, and also another row of holes aligned along a lower border of the plate (16), said plate having a surface disposed in three planes, a central plane of said plate including the slot (17), and the said plate (16) being mounted for pivotal movement about a pivoting axis (20) along its lower border to the body of the case (4), the pivoting axis (20) bearing also a pass roller (21) for the unwound web.

11. Machine, according to claim 10, in which each splicing case (4) is wider than the largest web to be unwound, in order to keep a free surface on its operator side to fit useful instruments or control buttons in the plate (16), as well as a shelter for the cutting device (18).

12. Machine, according to claim 10, in which the plates (16) of the cases (4) are symmetrical with regard to a vertical plane and fitted with power means to push or pull them to splice.

13. Machine, according to claim 10, in which each plate (16) has an additional long slot (24) parallel to the first-mentioned slot (17), both slots being distant from each other by at least the width of a double-face adhesive tape used to splice webs.

14. Machine, according to claim 10, comprising also marking equipment placed near the case (4) between the fixed part of the accumulator (3) and the top of the inclined slots (17) and (24) on the plate (16).

15. Machine according to claim 10, characterized by the fact that a removable counterpart bar is applied to the web along the cutting slot 17 to keep the web flat and to get a clean cut even with any non-rigid web.

* * * * *